US008919942B2

(12) United States Patent
Koike et al.

(10) Patent No.: US 8,919,942 B2
(45) Date of Patent: Dec. 30, 2014

(54) INK JET RECORDING METHOD, AND RECORD MADE BY THE SAME

(75) Inventors: Naoki Koike, Matsumoto (JP); Takayoshi Kagata, Shiojiri (JP)

(73) Assignee: Seiko Epson Corporation (JP)

( * ) Notice: Subject to any disclaimer, the term of this patent is extended or adjusted under 35 U.S.C. 154(b) by 396 days.

(21) Appl. No.: 13/356,878

(22) Filed: Jan. 24, 2012

(65) Prior Publication Data

US 2012/0212554 A1 Aug. 23, 2012

(30) Foreign Application Priority Data

Feb. 17, 2011 (JP) ..... 2011-031716
Aug. 12, 2011 (JP) ..... 2011-176572

(51) Int. Cl.
*B41J 2/01* (2006.01)
*B41M 7/00* (2006.01)
*B41J 2/21* (2006.01)

(52) U.S. Cl.
CPC ..... *B41M 7/009* (2013.01); *B41J 2/2107* (2013.01); *B41J 2/01* (2013.01)
USPC ..... 347/100; 347/96; 347/101

(58) Field of Classification Search
CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101
USPC ..... 347/100, 96, 95, 102, 101, 21, 20, 9, 347/88, 99, 105; 106/31.6, 31.13, 31.27; 523/160, 161
See application file for complete search history.

(56) References Cited

U.S. PATENT DOCUMENTS

| | | | | |
|---|---|---|---|---|
| 3,562,754 | A | 2/1971 | Gomez | |
| 4,880,465 | A | 11/1989 | Loria et al. | |
| 7,846,246 | B2 | 12/2010 | Oyanagi et al. | |
| 8,043,535 | B2 | 10/2011 | Kamikoriyama et al. | |
| 2007/0296790 | A1* | 12/2007 | Nakazawa et al. | 347/102 |
| 2008/0084466 | A1* | 4/2008 | Makuta et al. | 347/102 |
| 2008/0182085 | A1* | 7/2008 | Oyanagi et al. | 347/100 |

FOREIGN PATENT DOCUMENTS

| | | |
|---|---|---|
| JP | 2006-210301 | 8/2006 |
| JP | 2008-208330 | 9/2008 |
| JP | 2009-226863 | 10/2009 |

* cited by examiner

*Primary Examiner* — Manish S Shah
(74) *Attorney, Agent, or Firm* — Harness, Dickey & Pierce, P.L.C.

(57) ABSTRACT

An ink jet recording method includes preparing a bright image and improving the lightness, or the L* value, of the bright base image. More specifically, a bright image is formed using a bright pigment, and then an ink jet process is performed to discharge a white ink composition containing a white pigment onto the bright image with a weight per unit area ($g/cm^2$) in a range of 0.01 to 0.5, inclusive.

11 Claims, No Drawings

INK JET RECORDING METHOD, AND RECORD MADE BY THE SAME

Priority is claimed under 35 U.S.C. §119 to Japanese Application No. 2011-031716 filed on Feb. 17, 2011 and Application No. 2011-176572 filed on Aug. 12, 2011, which are hereby incorporated by reference in their entireties.

BACKGROUND

1. Technical Field

The invention relates to an ink jet recording method and records made by the ink jet recording method.

2. Related Art

Records carrying a bright image on their recording surface have recently been in growing demand. Known methods for recording bright images include pressing a metal foil sheet onto a recording medium having a smooth surface, depositing metal on a plastic film in vacuum, applying a bright ink to a recording medium and then compressing the medium with the ink, and so forth. However, these methods have disadvantages such as a complicated recording process and a limited range of suitable recording media, and thus some techniques to record bright images by an ink jet process have been proposed, including that disclosed in JP-A-2008-208330.

However, image formation by an ink jet process is disadvantageous in, for example, the following ways: The formed bright image (e.g., an image expressing metallic luster) has a low lightness; The image transfer method and the recording medium often involve the use of a bright material somewhat lacking in lightness, and this results in the failure to achieve the intended degree of lightness. In an ink jet recording method, a specific example of the image formation by an ink jet process, the bright ink contains a bright pigment in the form of metal fragments (e.g., aluminum fragments), metal particles (e.g., silver particles), or the like, and the use of these fragments or particles unfortunately leads to a reduced lightness of the image, making it difficult to form a bright image having an intended degree of lightness (or to increase the gloss of the image). In other words, known and ordinary techniques for recording a bright image on a white recording medium, for example, cannot achieve their aim because the formed image lacks in lightness at the portions that should be bright.

SUMMARY

An advantage of some aspects of the invention is that they solve the above problems at least in part, and these aspects of the invention can be embodied by the following applications.

Application 1

An application of an aspect of the invention is an ink jet recording method including preparing a bright image and improving the lightness, or the L*value, of the bright base image. More specifically, a bright image is formed using a bright pigment, and then an ink jet process is performed to discharge a white ink composition containing a white pigment onto the bright image with a weight per unit area (g/cm$^2$) in n a range of 0.01 to 0.5, inclusive.

Application 2

This application is an ink jet recording method according to Application 1. In this application, the freshly formed bright image has a glossiness equal to or higher than 250 as measured at 60° in accordance with Japanese Industrial Standard (JIS) Z 8741 (1997).

Application 3

This application is also an ink jet recording method according to Application 1. In this application, the L*value of the bright image is improved to be at least 60.

Application 4

This application is also an ink jet recording method according to Application 1. In this application, the bright base image after the lightness thereof is improved has a glossiness equal to or higher than 150 as measured at 60° in accordance with JIS Z 8741 (1997).

Application 5

This application is also an ink jet recording method according to Application 1. In this application, the ratio of the weight per unit area (g/cm$^2$) of the white ink composition to that of the bright image (g/cm$^2$) is in a range of 0.01 to 0.3, inclusive.

Application 6

This application is also an ink jet recording method according to Application 1. In this application, a value Ed is greater than 0. Ed is calculated by a formula L2/L1−1−(1−G2/G1), where L1 and G1 are the L*value and glossiness of the bright image before the lightness is improved, and L2 and G2 are those after the lightness is improved.

Application 7

This application is an ink jet recording method according to Application 6. In this application, a value Ef is greater than 1. Ef is calculated by a formula L2/L1×G2/G1.

Application 8

A record made by a recording method including using the ink jet recording method according to any one of Applications 1 to 7.

DESCRIPTION OF EXEMPLARY EMBODIMENTS

The following describes an embodiment of an aspect of the invention.

1. RECORDING METHOD

The recording method according to this embodiment uses an ink jet recording head to discharge an ink composition onto a recording medium. In the exemplary recording method described below, an ink jet recording apparatus having a recording head of this type discharges an ink composition onto a recording medium, and the ink composition adheres to the recording medium to form a group of dots.

1.1. Ink Jet Recording Apparatus

Ink jet recording apparatuses have a recording head that works on, for example, the following principles: electrostatic suction recording, recording by mechanical oscillations, piezoelectric recording, and thermal jet recording. In electrostatic suction printing, a strong electric field is applied between the nozzles of the recording head and accelerating electrodes situated in front of the nozzles, this electric field works to continuously eject the ink from the nozzles in the form of droplets, and the ink droplets travel to a recording medium through between deflecting electrodes, which provide the ink droplets with printing information signals during their travel; in some constitutions, however, the ink droplets are ejected in response to the printing information signals without being deflected. In printing by mechanical oscillations, a small pump pressurizes the ink, then quartz resonators or any other mechanical oscillation units make the nozzles oscillate, and thereby the ink is forcedly ejected in the form of droplets. In piezoelectric printing, piezoelectric elements pressurize the ink in response to printing information signals, and thereby the ink is ejected in the form of droplets and makes a record. In thermal jet printing, microelectrodes heat the ink in response to printing information signals and make it bubble, and thereby the ink is ejected in the form of droplets and makes a record. The recording method according to this embodiment may be any of the above recording-head-based methods or a method of any other type as long as the ink is ejected in the form of droplets and thereby forms a group of dots on a recording medium.

The ink jet recording apparatus used in this embodiment has an ink jet recording head, a main body, a recording medium feeding/ejecting mechanism, a recording head driving mechanism, a control board, ink cartridges, and other necessary components. The control board is for controlling the recording head driving mechanism, ink discharge, and feeding/ejection of the recording medium. The ink cartridges accommodate an ink set. The ink set is composed of, for example, inks for full-color printing (e.g., cyan, magenta, yellow, and black inks), a bright ink, and a white ink.

1.2. Recording Medium

Examples of recording media suitable for use in the recording method according to this embodiment include surface-treated papers such as coated paper, art paper, and cast-coated paper, and transparent or nontransparent resin films such as polyvinyl chloride sheets and polyethylene terephthalate (PET) films. Other recording media may also be used, including cloth, wood, plastics, and metals.

1.3. Ink Set

The ink set used in this embodiment is made up with a white ink and other inks. The white ink is a white ink composition containing a white pigment. Preferably, the ink set further includes a bright ink, which is a bright ink composition containing a bright pigment, and additionally includes a chromatic color pigment. In this aspect of the invention, each ink composition may be an aqueous or nonaqueous one. The aqueous ink composition as used herein represents ink compositions having a water content equal to or higher than 50% by mass, whereas the nonaqueous ink composition represents ink compositions having a water content lower than 50% by mass.

1.3.1. Bright Ink Composition

The bright ink composition should contain a bright pigment, but no particular limitation is imposed on the other components; it may be composed of an organic solvent, a surfactant, a polyhydric alcohol, and other necessary components in addition to the bright pigment.

The bright pigment may be of any kind as long as it allows the ink composition to be discharged in the form of droplets by an ink jet recording process while imparting brightness to the ink composition. Pearly pigments, metal pigments, and other similar pigments may be used as the bright pigment. Typical examples of pearly pigments include those having luster like a pearl or a luster brought about by interference, such as titanium-dioxide-coated mica, argentine, and bismuth trichloride. When the bright pigment is a metal pigment, it may be fragments or particles of one or more of the following metals and metallic substances: aluminum, silver, gold, platinum, nickel, chromium, tin, zinc, indium, titanium, copper, and other pure metals, their alloys, and their mixtures.

The bright pigment used in this embodiment is preferably one or a combination of aluminum, an aluminum alloy, and silver for a higher gloss (high brightness) and reduced cost. When an aluminum alloy is used, no particular limitation is imposed on the metal or nonmetal element added to aluminum as long as the element has brightness; silver, gold, platinum, nickel, chromium, tin, zinc, indium, titanium, copper, and other similar elements may be used. Preferably, aluminum is combined with one or more of these elements. When the organic solvent contained in the bright ink composition, detailed later, has low reactivity with metals, the bright pigment used in this aspect of the invention requires no special surface treatment.

In this embodiment, the bright pigment has a 50th percentile of average sphere-equivalent particle diameter (d50) in a range of 0.8 μm to 1.2 μm, inclusive, as measured by light scattering.

The following measurement and derivation operations are performed to determine d50 by light scattering. First, particles in a dispersion medium are irradiated with light, and the diffracted and scattered rays of light are measured using detectors located on the front, rear, and lateral sides. Then, a distribution curve is created with the measured average particle diameter as the horizontal axis and the cumulative percentage as the vertical axis; the average particle diameter at a cumulative percentage of 50% is a 50th percentile of average particle diameter, d50. The adjective sphere-equivalent means that the average particle diameter is determined from the results of a conversion and measurement process carried out on the assumption that the particles, which actually have no definite shape, are spheres. The bright pigment, having d50 or a 50th percentile of average sphere-equivalent particle diameter in the above range as measured by light scattering, allows the ink composition to form a highly bright image on a recording medium and to be discharged from nozzles with high stability.

The bright pigment is preferably in the form of tabular particles produced by pulverizing a metal deposition film. When the bright pigment is in the form of tabular particles, the 50th percentile of the sphere-equivalent diameters calculated for the tabular particles from the area of their X-Y plane (R50), where X and Y are the major and minor axes on the planar surface of the tabular particles and Z is the thickness, is preferably in a range of 0.5 μm to 3 μm, inclusive, and R50/Z is preferably larger than 5. The maximum sphere-equivalent diameter Rmax is preferably equal to or smaller than 10 μm for the prevention of nozzle clogging in an ink jet recording apparatus. The average thickness Z is preferably in a range of 5 nm to 100 nm, inclusive, more preferably 20 nm to 100 nm, inclusive. An average thickness equal to or larger than 5 nm ensures excellent reflectivity and brightness of the bright pigment and thereby leads to improved performance of the pigment, and an average thickness equal to or smaller than 100 nm results in a relatively low apparent specific gravity of the bright pigment and thereby imparts dispersion stability to the pigment.

The concentration of the bright pigment in the ink composition is preferably in a range of 0.5% by mass to 15% by mass, inclusive. If it is lower than 0.5% by mass, the formed image may be somewhat lacking in brightness. If it exceeds 15% by mass, clogging and other problems can occur.

The bright pigment does not always have to be in the form mentioned above, tabular particles; it may have the form of spherical particles or particle aggregates. When silver particles are used, their volume-average particle diameter is preferably in a range of 5 nm to 100 nm, inclusive. The average particle diameter of silver particles can be measured by, for example, using Microtrac UPA (Nikkiso Co., Ltd.) with the refractive index set at 0.2-3.9i, the refractive index of solvent (water) at 1.333, and the shape of particles as spheres.

When an organic solvent is used, it is preferably a polar organic solvent. Examples of suitable polar organic solvents include alcohols (e.g., methyl alcohol, ethyl alcohol, propyl alcohol, butyl alcohol, isopropyl alcohol, and fluoroalcohols), ketones (e.g., acetone, methyl ethyl ketone, and cyclohexanone), carboxylates (e.g., methyl acetate, ethyl acetate, propyl acetate, butyl acetate, methyl propionate, and ethyl propionate), and ethers (e.g., diethyl ether, dipropyl ether, tetrahydrofuran, and dioxane). More preferably, the organic solvent contains one or more alkylene glycol ethers that are liquid at room temperature and atmospheric pressure.

Alkylene glycol ethers include ethylene-glycol-type ones and propylene-glycol-type ones, and the glycol ethers of both types can be based on aliphatic groups such as methyl, n-propyl, i-propyl, n-butyl, i-butyl, hexyl, and 2-ethylhexyl groups, allyl group, which has a double bond, and phenyl group. Alkylene glycol ethers are liquid at room temperature, colorless, and relatively odorless, and they have ether and hydroxy groups in the molecule and thus combine the functionality of alcohols and ethers. These ethers can be divided into two forms, monoethers and diethers. Alkylene glycol monoethers have had either hydroxy group substituted, whereas alkylene glycol diethers have had both hydroxy groups substituted, and these monoethers and diethers may be used in combination. It is particularly preferred that the organic solvent is a mixture of an alkylene glycol diether, an alkylene glycol monoether, and a lactone.

Examples of suitable alkylene glycol monoethers include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, dipropylene glycol monomethyl ether, and dipropylene glycol monoethyl ether.

Examples of suitable alkylene glycol diethers include ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

Examples of suitable lactones include γ-butyrolactone, δ-valerolactone, and ϵ-caprolactone.

Appropriate combinations of organic solvents such as those mentioned above ensure that this aspect of the invention can provide its advantages in a more effective and consistent manner. One of the most preferred combinations is the combination of diethylene glycol diethyl ether, tetraethylene glycol monobutyl ether, and γ-butyrolactone and/or tetraethylene glycol dimethyl ether.

Examples of suitable surfactants include nonionic surfactants such as acetylene glycol surfactants, sorbitan fatty acid esters, polyoxyethylene sorbitan fatty acid esters, polyethylene glycol fatty acid esters, polyoxyethylene alkyl phenyl ethers, and aliphatic diethanol amide surfactants. When a polymeric dispersant is used, it is preferably a polymer having a molecular weight equal to or greater than 1000. Examples of suitable polymers for this purpose include styrene-maleic acid resins, styrene-acrylic resins, rosin, fluorine-modified polymers, polyurethanes, polyacrylates, aliphatic diethanolamides, polyesters, and polyester-polyamide resins.

Examples of suitable polyhydric alcohols include ethylene glycol, diethylene glycol, triethylene glycol, polyethylene glycol, polypropylene glycol, propylene glycol, butylene glycol, 1,2-alkanediols having 4 to 8 carbon atoms such as 1,2-butanediol, 1,2-pentanediol, 1,2-hexanediol, 1,2-heptanediol, and 1,2-octanediol, 1,2,6-hexanetriol, thioglycol, hexylene glycol, glycerol, trimethylolethane, and trimethylolpropane.

When the ink compositions for this embodiment are used with an ink jet recording apparatus, these polyhydric alcohols can prevent the ink compositions from drying and from clogging in the ink jet recording head unit.

1.3.2. White Ink Composition

The white ink composition should contain a white pigment, but no particular limitation is imposed on the other components; it may be composed of an organic solvent, a surfactant, and other necessary components in addition to the white pigment.

Examples of suitable white pigments for use in this ink composition include oxides of group-IV elements such as titanium dioxide and zirconium dioxide. Other white pigments may also be used, including calcium carbonate, calcium sulfate, zinc oxide, barium sulfate, barium carbonate, silica, alumina, kaoline, clay, talc, white earth, aluminum hydroxide, and magnesium carbonate; the white pigment is preferably one or a mixture of two or more selected from the group consisting of these and other similar white materials.

The color white as used herein for inks, ink compositions, and pigments includes all colors commonly accepted as white; for example, the white ink includes not only white inks but also all slightly colored whitish inks. Furthermore, inks commercially available under a trade name using any words corresponding to "white" and those commonly called by a name including such words are all included in the white ink. For example, the white ink includes the inks with which the brightness (L*) and chromaticity parameters (a* and b*) fall within the ranges $70 \leq L^* \leq 100$, $-4.5 \leq a^* \leq 2$, and $-6 \leq b^* \leq 2.5$ when the ink is recorded onto Epson's genuine Photo Paper Glossy (Seiko Epson Corp.) at a duty of at least 100% or in an amount that can fully coat the surface of the photographic paper sheets and analyzed using Spectrolino spectrophotometer (a trade name; available from GratagMacbeth) with the following settings: light source: D50; field of view: 2°; density: DIN NB; white balance: Abs; filter: No; mode of measurement: Reflectance.

The volume-average particle diameter of the white pigment is preferably in a range of 100 nm to 700 nm, inclusive, more preferably 200 nm to 600 nm, inclusive. If it exceeds this range, the particles of the white pigment can settle down in the ink composition and the dispersion stability of the ink composition is affected, and, when the ink composition is used with an ink jet recording apparatus, nozzle clogging and other problems can occur. If it is smaller than the above range, however, the ink composition often lacks whiteness. In particular, when titanium dioxide particles are used as the white pigment, the volume-average particle diameter of the titanium dioxide particles is preferably in a range of 280 nm to 440 nm, inclusive. This ensures that the ink composition can be discharged by an ink jet recording apparatus from its nozzles.

The volume-average particle diameter can be measured by a particle size distribution analyzer that works on the measurement principle of dynamic light scattering. The volume-average particle diameter as used herein represents the average diameter weighted by volume and is calculated from the measured volumes and diameters of the individual particles by the following equation:

$$\text{Volume-average particle diameter} = \Sigma(Vi \cdot di)/\Sigma(Vi)$$

(where Vi represents the volume of particle i [i=1, 2, . . . , n] and di represents the diameter of particle i [i=1, 2, . . . , n]).

The white material in the white ink composition may be in the form of particles having a hollow structure. Known kinds of hollow particles may be used without particular limitation, including those described in U.S. Pat. No. 4,880,465 and those described in U.S. Pat. No. 3,562,754.

Hollow particles are each composed of a core and a shell and therefore have an outer diameter and an inner diameter. When hollow particles are used, their volume-average particle diameter (outer diameter, d50) is preferably in a range of 100 nm to 700 nm, inclusive, more preferably 200 nm to 600 nm, inclusive. Hollow particles having an outer diameter falling within this range can be well dispersed in the white ink composition, and the ink composition can form an image with good whiteness on a recording medium. If the outer diameter exceeds 700 nm, however, the particles can settle down in the ink composition and the dispersion stability of the ink composition is affected, and, when the ink composition is used with an ink jet recording apparatus, problems such as clogging in the head can occur. If the outer diameter is smaller than 100 nm, the ink composition may be lacking in whiteness. As for the inner diameter of the hollow particles (i.e., the outer diameter of the core mentioned above), it is appropriate that it is on the order of 100 nm to 500 nm. The volume-average particle diameter of hollow particles can be measured in the same way as that of metal oxide particles.

The white pigment content is preferably in a range of 1% by mass to 20% by mass, inclusive, more preferably 5% by mass to 15% by mass, inclusive, relative to the total mass of the white ink composition.

As for organic solvents and surfactants, examples of suitable ones are the same as those for the bright ink composition.

1.3.3. Chromatic Ink Compositions

The chromatic ink composition as used herein is an ink composition containing a chromatic pigment. The chromatic colors include all colors excluding the series of colors ranging from white via gray to black (achromatic colors). When chromatic pigments are used, they are preferably organic pigments for improved storage stability-related properties, such as resistance to light, weathering, and fumes.

Specific examples of suitable chromatic pigments include azo pigments such as insoluble azo pigments, condensed azo pigments, azo lake pigments, and chelate azo pigments, polycyclic pigments such as phthalocyanine pigments, perylene and perinone pigments, anthraquinone pigments, quinacridone pigments, dioxane pigments, thioindigo pigments, isoindolinone pigments, and quinophthalone pigments, dye chelate pigments, dye lake pigments, nitro pigments, nitroso pigments, aniline black, daylight fluorescent pigment, and so forth. These pigments may be used alone or in combination of two or more kinds.

1.4. Ink Jet Recording Method

In this embodiment, the above-described ink jet recording apparatus discharges the above-described ink compositions onto the above-described recording medium to perform ink jet recording. In this aspect of the invention, the lightness improvement is always carried out by an ink jet process, but the bright image formation does not always have to be done by an ink jet process. A bright image is first prepared, and then the L*value of the bright base image is improved. After that, an image is formed on the base having an improved L*value; the lightness of the bright image obtained in this way is closer to the desired level than that of the original bright image is.

First, a bright image (or an image on a bright recording medium) is prepared. The bright image may be recorded by any process; for example, it may be recorded by using an analog coater such as a bar coater or a slit coater, by an image transfer process such as that described in JP-A-2009-226863 or that in Example 7 below, by forming an image on a recording medium having a bright tone such as WXMPF17R (Seiko Epson Corp.), or by applying the bright ink composition by an ink jet process. Here, the glossiness and lightness (L*value) of the bright image on the recording medium are defined as G1 and L1, respectively.

The glossiness of the freshly formed (prepared) base image is preferably equal to or higher than 250, more preferably equal to or higher than 300, even more preferably equal to or higher than 350, when measured at 60° in accordance with Japanese Industrial Standard (JIS) Z 8741 (1997). If it is lower than the above value, the brightness of the image is low even after the white ink composition is applied, and the base image can no longer be accepted as having favorable brightness.

The bright image is formed by discharging the bright ink composition onto a recording medium (in advance), and the weight per unit area (g/cm$^2$) of this ink composition is preferably in a range of 0.2 to 1, inclusive, more preferably 0.35 to 0.8, inclusive. When a white recording medium is used, applying the bright ink composition in a small amount often results in an improved L*value because of the whiteness of the recording medium; however, the insufficiency of the amount of the bright ink may cause the image to be lacking in brightness. When the bright ink composition on the recording medium contains both a bright pigment and a resin component, the calculation of its weight per unit area is based on the total solid content of resin.

Then, the base image formed as above is coated with the white ink composition discharged thereonto to improve the L*value of the bright base image. The glossiness and lightness (L*value) of the obtained base image are defined as G2 and L2, respectively. The weight per unit area (g/cm$^2$) of the white ink composition is in a range of 0.01 to 0.5, inclusive. When it falls within this range, either Ef or Ed, defined below, has a favorable value. Preferably, the weight per unit area (g/cm$^2$) of the white ink composition is in a range of 0.01 to 0.15, inclusive. When it falls within this range, Ef and Ed both have a favorable value. When the white ink composition contains both a white pigment and a resin component, the calculation of its weight per unit area is based on the total solid content of resin. Note that the glossiness as used herein is the glossiness at 60° unless otherwise specified.

In addition, the ratio of the weight per unit area (g/cm$^2$) of the white ink composition to that of the bright image (g/cm$^2$) is in a range of 0.01 to 0.3, inclusive, more i preferably 0.01 to 0.1, inclusive.

The compatibility of the gloss of the obtained base image with its lightness can be quantitatively evaluated using an index value Ed, which is calculated by the following formula: Increase in the L*value−1−(1−Change in glossiness). One can improve the L*value while suppressing the decrease in glossiness by achieving Ed equal to or greater than 1. The value Ed is preferably greater than 0, more preferably equal to or greater than 0.07.

Another index value Ef, which is calculated by the formula Increase in the L*value×Change in glossiness, is preferably greater than 1, more preferably equal to or greater than 1.3. L2 and G2 of the base image are preferably equal to or greater than 60 and equal to or greater than 150, respectively, more preferably equal to or greater than 65 and equal to or greater than 175, respectively, even more preferably equal to or greater than 70 and equal to or greater than 200, respectively.

The base image, when satisfying these conditions, allows an image to be formed thereon using other inks (e.g., those containing chromatic pigments) with a higher lightness than that can be achieved by known methods. In the above formula, the terms Increase in the L*value and Change in glossiness are calculated by L2/L1 and G2/G1, respectively. L1 and G1 are the L*value and glossiness of the bright base image before the lightness thereof is improved, and L2 and G2 are those after the lightness is improved.

2. EXAMPLES

The following describes this aspect of the invention in more detail with reference to examples; however, the scope of this aspect of the invention is not limited to these examples.

2.1. Preparation of a Bright Ink Composition

First, a bright pigment dispersion (an aluminum pigment dispersion) was prepared as follows, and a bright pigment for the bright ink composition was obtained therefrom.

A resin-layer coating solution was uniformly applied to a PET film by a bar coating process. The coating solution consisted of 3% by mass of cellulose acetate butyrate (butyryl content: 35 to 39%) and 97% by mass of diethylene glycol diethyl ether, and the PET film had a thickness of 100 μm. The coating was dried at 60° C. for 10 minutes to form a thin resin layer on the PET film. Subsequently, an aluminum layer having an average thickness of 20 nm was formed on this resin layer in a vacuum coating system. The obtained laminate was put into diethylene glycol diethyl ether and treated in an ultrasonic disperser for detachment, pulverization, and dispersion. After 12 cumulative hours of ultrasonic dispersion, the resultant bright pigment dispersion was collected. The obtained aluminum pigment dispersion was filtered through a 5-μm SUS (stainless steel) mesh filter to remove coarse particles. The filtrate was received in a round-bottom flask, and this flask was subjected to a rotary evaporator to distill off diethylene glycol diethyl ether. The obtained aluminum pigment dispersion concentrate was diluted to a concentration of 5% by mass (aluminum pigment dispersion 1). The 50th percentile of average sphere-equivalent particle diameter by light scattering, d50, was measured using a laser diffraction/scattering particle size distribution analyzer and it was 1.001 μm.

From aluminum pigment dispersion 1 prepared in this way, a bright ink composition was prepared. Table 1 presents its formulation.

The bright ink composition was obtained by blending 2% by mass of aluminum pigment dispersion 1, 40% by mass of diethylene glycol diethyl ether (DEGDE), 10% by mass of γ-butyrolactone, 10% by mass of tetraethylene glycol dimethyl ether (TEGDM), 3% by mass of tetraethylene glycol monobutyl ether (TEGMB), 0.2% by mass of surfactant BYK-UV3500 (a trade name; available from BYK Japan KK), and isopropyl alcohol as the balance and then stirring the mixture at room temperature and atmospheric pressure for 30 minutes using a magnetic stirrer to provide an aluminum pigment ink (bright ink 1).

TABLE 1

| | Ingredients | % |
|---|---|---|
| Bright ink composition 1 | Aluminum pigment dispersion | 2 |
| | DEGDE | 40 |
| | γ-Butyrolactone | 10 |
| | TEGDM | 10 |
| | TEGMB | 3 |
| | BYK-UV3500 | 0.2 |
| | Isopropyl alcohol | Balance |
| | Total | 100 |

Separately, bright ink 2 for image transfer was prepared as follows. In 50 mL of water alkalinized with 3 mL of 10 N NaOH aqueous solution, 17 g of trisodium citrate dihydrate and 0.36 g of tannic acid were dissolved. To the obtained solution 3 mL of 3.87 mol/L silver nitrate aqueous solution was added, and the obtained mixture was stirred for 2 hours to form a silver colloid solution. This silver colloid solution was desalted by dialysis until its electric conductivity fell below 30 μS/cm. After the completion of dialysis, the solution was centrifuged at 3000 rpm for 10 minutes to remove coarse metal colloid particles. The average diameter of the silver particles was measured using Microtrac UPA (Nikkiso Co., Ltd.) with the refractive index set at 0.2-3.9i, the refractive index of solvent (water) at 1.333, and the shape of particles as spheres. The average particle diameter was measured to be 10 nm.

Subsequently, bright ink 2 was prepared from this silver colloid solution and some other ingredients in the way described above. Its formulation was as follows: 10% by mass (solid content) of the silver colloid solution, 1% by mass of surfactant Olfine E1010, 11% by mass of propylene glycol, 5% by mass of 1,2-hexanediol, and ion-exchanged water as the balance.

2.2. Preparation of a White Ink Composition

A white ink composition containing titanium dioxide, a white pigment, was prepared as described below. Table 2 presents its formulation.

First, a titanium dioxide dispersion was prepared as follows.

A copolymer composed of acrylic acid, n-butyl acrylate, benzyl methacrylate, and styrene was mixed with and dissolved in diethylene glycol diethyl ether, in a ratio of 25 parts by mass of the copolymer to 75 parts by mass of the solvent, to form a polymeric dispersant solution having a resin solid content of 25% by mass. The copolymer was solid, and its glass transition temperature, weight-average molecular weight, and acid value were 40° C., 10,000, and 150 mg KOH, respectively.

To 36% by mass of this polymeric dispersant solution, 19% by mass of diethylene glycol diethyl ether was added. After the two components were mixed to form resin varnish as a dispersant for titanium dioxide, 45% by mass of titanium dioxide was added. The titanium dioxide used here was CR-90 (Ishihara Sangyo Kaisha, Ltd.), modified with alumina and silica (alumina/silica≥0.5), and its volume-average particle diameter and oil absorption were 300 nm and 21 mL/100 g, respectively. The mixture was stirred and then milled to form ink using a wet circulation mill. In this way, a titanium dioxide dispersion was obtained.

Subsequently, white ink composition 1 was prepared by 10% by mass of the titanium dioxide dispersion, 40% by mass of DEGDE, 10% by mass of γ-butyrolactone, 10% by mass of TEGDM, 3% by mass of TEGMB, 0.2% by mass of surfactant BYK-UV3500 (BYK Japan KK), and isopropyl alcohol as the balance and then stirring the mixture at room temperature and atmospheric pressure for 30 minutes using a magnetic stirrer to provide an titanium dioxide pigment ink (white ink).

Separately, white ink composition 2 was prepared for use in Example 6 below. As presented in Table 3, its formulation consisted of 10% by mass of hollow resin particles (SX8782 (D), JSR Corporation), 10% by mass of glycerol, 3% by mass of 1,2-hexanediol, 1% by mass of BYK-348 (BYK Japan KK), and ion-exchanged water as the balance.

TABLE 2

| | Ingredients | % |
|---|---|---|
| White ink composition 1 | Titanium dioxide dispersion | 10 |
| | DEGDE | 40 |
| | γ-Butyrolactone | 10 |
| | TEGDM | 10 |
| | TEGMB | 3 |

TABLE 2-continued

| | Ingredients | % |
|---|---|---|
| | BYK-UV3500 | 0.2 |
| | Isopropyl alcohol | Balance |
| | Total | 100 |

TABLE 3

| | Ingredients | % |
|---|---|---|
| White ink composition 2 | Hollow resin particles | 10 |
| | Glycerol | 10 |
| | 1,2-Hexanediol | 3 |
| | BYK-348 | 1 |
| | Ion-exchanged water | Balance |
| | Total | 100 |

2.3. Preparation of Records

PX-G930 ink jet printer (Seiko Epson Corp.) was used to prepare the records for the examples and comparative examples described below. The ink compositions for each example or comparative example were each filled in the black ink tank of a dedicated cartridge for the printer, the cartridge was loaded into the printer, and a print was made using this printer. The recording medium was Photo Paper Glossy (Seiko Epson Corp.). The printing conditions were the same for all samples: type of paper: Shashin youshi, kotaku (photographic paper, glossy); color correction: disabled; image quality: Foto (photographic); resolution: 1440 dpi; printing mode: one-way printing.

Example 1 to 6

In each example, as summarized in Table 4, the bright ink composition was first discharged by an ink jet process to form a bright image, and subsequently this bright base image was coated with the white ink composition discharged thereonto to have its L*value improved.

Records were prepared with various combinations of the recording density of the bright ink composition (the percent duty in the first column of Table 4) and that of white ink composition 1 (the percent duty in the top row of Table 4), the combinations grouped into Examples 1 to 6 and Comparative Example 1, and the changes in the L*value and gloss of these records were quantitatively evaluated. In Example 6, white ink composition 2 was used.

The examples correspond to the combinations of recording density with which the record achieved grade B or a better grade in at least one of the evaluation tests described later.

TABLE 4

| | Example 1 Duty 1% | Example 2 Duty 3% | Example 3 Duty 5% | Example 4 Duty 10% | Example 5 Duty 20% | Example 6 Duty 3% | Comparative Example 1 Duty 0% |
|---|---|---|---|---|---|---|---|
| Duty 40% | Example 1-(1) | Example 2-(1) | Example 3-(1) | Example 4-(1) | Example 5-(1) | Example 6-(1) | Comparative Example 1-(1) |
| Duty 60% | Example 1-(2) | Example 2-(2) | Example 3-(2) | Example 4-(2) | Example 5-(2) | Example 6-(2) | Comparative Example 1-(2) |

In Examples 1 to 6, the recording density of the bright ink composition (duty) was 20%, 40%, or 60%, and that of the white ink composition (duty) was 1%, 3%, 5%, 10%, or 20%, as summarized Table 4. The records of Comparative Example 1 carried a bright base image only and had no white ink composition coating; they did not have their lightness improved. The duty is the value calculated by the following equation:

$$\text{Duty}(\%)=\text{Actual number of dots printed}/(\text{Vertical resolution}\times\text{Horizontal resolution})\times 100$$

(where Actual number of dots printed is the number of actually printed dots per unit area, and Vertical resolution and Horizontal resolution are the pixel resolutions along the unit length).

2.4. Evaluation of the Records

The records prepared in this way were evaluated for lightness (whiteness) and gloss, and the results were used to assess some advantages of an aspect of the invention.

The lightness of an image formed by an ink composition on a recording medium can be evaluated by the L*value of the image. The L*value of an image can be determined by, for example, measurement using a commercially available spectrometer such as 938 Spectrodensitometer (X-Rite, Inc.).

On the other hand, the gloss of an image formed by an ink composition on a recording medium can be evaluated by the method specified in Japanese Industrial Standard (JIS) Z 8741 (1997), Specular glossiness-Methods of measurement. More specifically, the glossiness can be determined by irradiating the image with light from the specified angles of incidence, measuring the intensity of light with photodetectors situated at the angles of reflection, and then calculating the glossiness from the intensity measurements. Examples of analyzers supporting this kind of measurement include Multi Gloss 268 (Konica Minolta Sensing, Inc.) and Gloss Meter VGP5000 (Nippon Denshoku Industries Co., Ltd.). In the present examples, Multi Gloss 268 (Konica Minolta Sensing, Inc.) was used.

Table 5 summarizes the measurements obtained with the records of Examples 1 to 6 and Comparative Example 1. In Table 5, the L*values and glossiness measurements of Examples 1 to 6 and Comparative Example 1 are those obtained with the duty of the bright ink composition set at 40% and 60%. The glossiness values were determined by measuring the reflection of light at an angle of incidence of 60°.

TABLE 5

| | | Example 1 Duty 1% | Example 2 Duty 3% | Example 3 Duty 5% | Example 4 Duty 10% | Example 5 Duty 20% | Example 6 Duty 3% | Comparative Example 1 Duty 0% |
|---|---|---|---|---|---|---|---|---|
| L* value | Duty 40% | 73.8 | 74.4 | 66.5 | 73.2 | 74.2 | 73.5 | 62.2 |
| | Duty 60% | 70.8 | 70.8 | 70.5 | 69.1 | 69.2 | 69.9 | 55.3 |
| Glossiness | Duty 40% | 207 | 196 | 202 | 190 | 190 | 202 | 225 |
| | Duty 60% | 248 | 246 | 223 | 225 | 208 | 217 | 272 |
| L2/L1 | Duty 40% | 1.19 | 1.20 | 1.07 | 1.18 | 1.19 | 1.18 | 1.00 |
| | Duty 60% | 1.28 | 1.28 | 1.27 | 1.25 | 1.25 | 1.26 | 1.00 |
| G2/G1 | Duty 40% | 0.92 | 0.87 | 0.89 | 0.84 | 0.84 | 0.89 | 1.00 |
| | Duty 60% | 0.91 | 0.90 | 0.82 | 0.82 | 0.76 | 0.80 | 1.00 |
| Ef | Duty 40% | 1.09 | 1.04 | 0.96 | 0.99 | 1.00 | 1.06 | 1.00 |
| | Duty 60% | 1.17 | 1.16 | 1.04 | 1.03 | 0.96 | 1.01 | 1.00 |
| Ed | Duty 40% | 0.11 | 0.07 | −0.04 | 0.02 | 0.03 | 0.08 | 0.00 |
| | Duty 60% | 0.19 | 0.19 | 0.09 | 0.07 | 0.02 | 0.06 | 0.00 |

Table 5 presents Ed and Ef values calculated at each duty. They are index values for the balance between lightness and gloss. Ed represents the difference between the increase in the L*value and the change in glossiness and is calculated by a formula 1—Increase in the L*value−(Change in glossiness−1), whereas Ef represents the product and is calculated by a formula Increase in the L*value×Change in glossiness. The baseline values were the L*values and glossiness measurements of Comparative Example 1, in which no white ink composition was used (the base image did not have its lightness improved); the values of Ef and Ed were calculated with the L*value and glossiness of Comparative Example 1 as L1 and G1 and those after the discharge of the white ink composition (the lightness was improved) as L2 and G2. In other words, Ef and Ed are indices of the compatibility of the improvement of lightness with that of gloss with respect to Comparative Example 1.

The measurements were evaluated in accordance with predefined criteria.

For Ed, Increase in the L*value−1−(1−Change in glossiness), the following grades and criteria were used:

A (better): 0.07≤Ed;

B (good): 0.00<Ed<0.07;

C (acceptable): −0.05<Ed≤0.00;

D (no good): Ed≤−0.05.

For Ef, Increase in the L*value×Change in glossiness, the following grades and criteria were used:

A (better): 1.05≤Ef;

B (good): 1.00<Ef<1.05;

C (acceptable): 0.95<Ef≤1.00;

D (no good): Ef≤0.95.

A sensory test of gloss was also conducted. Ten panelists evaluated the gloss of samples, which were prints made on sheets of A4-sized photographic paper, by assigning a score of 0, 1, 2, or 3 to each sample. The average score Es was calculated and graded in accordance with the following criteria:

A (good): 2.0≤Es;

B (effective): 1.0≤Es<2.0;

C (slightly effective): 0<Es<1.0;

D (no good): Es=0.

Table 6 summarizes the evaluations made in accordance with the above criteria.

TABLE 6

| | Example 1 Duty 1% | | | Example 2 Duty 3% | | | Example 3 Duty 5% | | | Example 4 Duty 10% | | | Example 5 Duty 20% | | | Example 6 Duty 3% | | | Comparative Example 1 Duty 0% | | |
|---|---|---|---|---|---|---|---|---|---|---|---|---|---|---|---|---|---|---|---|---|---|
| | Ef | Ed | Es | Ef | Ed | Es | Ef | Ed | Es | Ef | Ed | Es | Ef | Ed | Es | Ef | Ed | Es | Ef | Ed | Es |
| Duty 40% | A | A | A | B | A | A | C | C | B | C | B | B | B | B | B | B | A | B | C | C | — |
| Duty 60% | A | A | A | A | A | A | B | A | B | B | A | B | C | B | B | B | B | B | C | C | — |

Table 7 summarizes the duty values and the corresponding weights per unit area for each ink composition. Although the lower duty value for the bright ink resulted in relatively high L*values of the bright base image, this is presumably because the dots of the bright ink on the recording medium were sparse and the whiteness of the white recording medium made some contribution to the measurement.

TABLE 7

| | | | Duty40% | | Duty60% |
|---|---|---|---|---|---|
| Bright ink 1 [mg/cm$^2$] | | | 0.496 | | 0.744 |
| | Duty1% | Duty3% | Duty5% | Duty10% | Duty20% |
| White ink 1 [mg/cm$^2$] | 0.021 | 0.063 | 0.104 | 0.209 | 0.418 |

3. EMBODIMENTS

A more preferred recording method according to the above embodiment provides a bright base image having an L*value equal to or higher than 60 and a glossiness equal to or higher than 150 as measured in accordance with JIS Z 8741 (1997). An image can be formed on this base image using chromatic and black inks, and the resultant full-color bright image has a desired level of lightness.

4. MODIFICATIONS

Examples 7 and 8 in Table 8 were prepared as follows. First, an aqueous silver ink was applied to a transfer sheet (a sheet of Photo Paper Glossy) using PX-5500 ink jet printer (Seiko Epson Corp.) at a duty of 50%. The obtained image was dried first by heating from the backside of the transfer sheet with a heating platen at 50° C. and then by exposure to warm air at 40° C. until all liquid evaporated from the adhering ink. Subsequently, an ink containing an adhesive material was discharged using an ink jet head onto the surface of the transfer sheet carrying the image, to form an adhesive layer. The obtained print was put into a drying apparatus, and the liquid component was further evaporated and dried (exposure to warm air at 50° C. for 20 seconds) to form a transfer medium. A recording medium was placed on and pressed onto the adhesive layer. Then, the image was removed from the transfer medium. This image transfer process was performed using JOL-DIGITAL-4R230 (Japan Office Laminator Inc.) with the following settings: temperature of the thermal compression bonding rollers: 130° C.; pressure: 30 kg/cm$^2$; speed: 20 cm/sec. The obtained image was coated with white ink composition 1 discharged thereonto at the duty specified in Table 7.

TABLE 8

| | Example 7 Duty 1% | Example 8 Duty 3% | Comparative Example 2 Duty 0% | Example 7 Duty 1% | | | Example 8 Duty 3% | | | Comparative Example 2 Duty 0% | | |
|---|---|---|---|---|---|---|---|---|---|---|---|---|
| L* value | 45.69 | 52.3 | 36.77 | Ef | Ed | Es | Ef | Ed | Es | Ef | Ed | Es |
| Glossiness | 433 | 306 | 511 | A | A | A | D | B | A | C | C | — |
| L2/L1 | 1.24 | 1.42 | 1.00 | | | | | | | | | |
| G2/G1 | 0.85 | 0.60 | 1.00 | | | | | | | | | |
| Ef | 1.05 | 0.85 | 1.00 | | | | | | | | | |
| Ed | 0.09 | 0.02 | 0.00 | | | | | | | | | |

What is claimed is:

1. An ink jet recording method comprising:

preparing a bright image using a bright pigment; and improving lightness, or an L* value, of the bright base image by performing an ink jet process to discharge a white ink composition containing a white pigment onto the bright image, wherein a value Ed calculated by the formula below is greater than 0:

$$L2/L1-1-(1-G2/G1),$$

where L1 and G1 are the L* value and glossiness of the bright image before the lightness is improved, and L2 and G2 are those after the lightness is improved; and wherein a value Ef calculated by the formula below is greater than 1:

$$L2/L1\times G2/G1.$$

2. The ink jet recording method according to claim 1, wherein the freshly formed bright image has a glossiness equal to or higher than 250 as measured at 60° in accordance with Japanese Industrial Standard (JIS) Z 8741 (1997).

3. The ink jet recording method according to claim 1, wherein the L* value of the bright image is improved to be at least 60.

4. The ink jet recording method according to claim 1, wherein the bright base image after the lightness thereof is improved has a glossiness equal to or higher than 150 as measured at 60° in accordance with JIS Z 8741 (1997).

5. The ink jet recording method according to claim 1, wherein a ratio of the weight per unit area (g/cm$^2$) of the white ink composition to that of the bright image (g/cm$^2$) is in a range of 0.01 to 0.3, inclusive.

6. A record made by a recording method including using the ink jet recording method according to claim 1.

7. A record made by a recording method including using the ink jet recording method according to claim 2.

8. A record made by a recording method including using the ink jet recording method according to claim 3.

9. A record made by a recording method including using the ink jet recording method according to claim 4.

10. A record made by a recording method including using the ink jet recording method according to claim 5.

11. The ink jet recording method according to claim 1, wherein the white ink composition containing the white pigment has a weight per unit area (g/cm$^2$) in a range of 0.01 to 0.5, inclusive.

* * * * *